US005266887A

United States Patent [19]

Smith

[11] Patent Number: 5,266,887

[45] Date of Patent: * Nov. 30, 1993

[54] BIDIRECTIONAL VOLTAGE TO CURRENT CONVERTER

[75] Inventor: Michael D. Smith, Lewisville, Tex.

[73] Assignee: Dallas Semiconductor Corp., Dallas, Tex.

[ * ] Notice: The portion of the term of this patent subsequent to Jun. 4, 2008 has been disclaimed.

[21] Appl. No.: 870,187

[22] Filed: Apr. 10, 1992

Related U.S. Application Data

[63] Continuation of Ser. No. 710,218, Jun. 4, 1991, abandoned, which is a continuation of Ser. No. 198,163, May 24, 1988, Pat. No. 5,021,730.

[51] Int. Cl.[5] ..... G05F 3/24

[52] U.S. Cl. ..... 323/316; 307/261; 330/253; 330/255

[58] Field of Search ..... 323/268, 270, 274, 280, 323/299, 303, 311, 313, 315, 316, 317; 307/261; 330/255, 253

[56] References Cited

U.S. PATENT DOCUMENTS

| | | | |
|---|---|---|---|
| 3,745,477 | 7/1973 | Freeborn | 330/255 |
| 4,194,240 | 3/1980 | Davis | 363/126 |
| 4,251,743 | 2/1981 | Hareyama | 323/316 |
| 4,302,726 | 11/1981 | Shobbrook | 330/260 |
| 4,651,083 | 3/1987 | Lachmann et al. | 323/316 |
| 4,689,607 | 8/1987 | Robinson | 323/315 |
| 4,706,013 | 11/1987 | Kuo | 323/316 |
| 4,730,168 | 3/1988 | Senderowicz et al. | 330/255 |
| 4,740,743 | 4/1988 | Reisinger et al. | 323/317 |
| 4,814,688 | 3/1989 | Colles | 323/317 |
| 4,829,266 | 5/1989 | Pernici et al. | 330/253 |
| 5,021,730 | 6/1991 | Smith | 323/316 |

FOREIGN PATENT DOCUMENTS

| | | | |
|---|---|---|---|
| 234110 | 10/1986 | Japan | 330/253 |

*Primary Examiner*—William H. Beha, Jr.
*Attorney, Agent, or Firm*—Worsham, Forsythe, Sampels & Wooldridge

[57] ABSTRACT

A bidirectional voltage to current converter circuit with extended dynamic range includes a first and second operational amplifier in which the input voltage terminal is connected to the negative input of both operational amplifiers. The outputs of the operational amplifiers each directly drive the gates of two transistors which operate as a current mirror circuit. The current mirror transistors associated with the first operational amplifier are p-channel transistors with their sources connected to VDD, and the two transistors driven by the second operational amplifier are n-channel transistors with their sources connected to ground. The drains of the first p-channel transistor and the first n-channel transistor are coupled back to the positive inputs of the first and second operational amplifiers respectively; and also each drain is separately connected to one end of a resistor, the other ends of the two resistors are connected together and to a reference voltage. The drains of the second p-channel transistor and the second n-channel transistor are connected together to form a current output terminal.

4 Claims, 2 Drawing Sheets

BIDIRECTIONAL VOLTAGE TO CURRENT CONVERTER

This is a continuation of application Ser. No. 710,218, filed Jun. 4, 1991 now abandoned which is a continuation of application Ser. No. 198,163, filed May 24, 1988 now U.S. Pat. No. 5,021,780.

TECHNICAL FIELD

This invention relates to electronic circuits, and more particularly, to voltage to current converter circuits.

BACKGROUND OF THE INVENTION

Voltage to current converter circuits generally provide a linear transformation of an input voltage level to an output current level for use in applications in which a current level signal rather than a voltage level signal is required as an input signal to another circuit.

In prior art voltage to current converter circuits the input voltage range over which the circuit is linear is usually significantly less than the power supply voltage levels used by the voltage to current converter circuit. This linear range of input voltage is referred to herein as a dynamic range of the circuit and limits the input voltage range which can be used with these prior art circuits. While the input voltage signal can be scaled down and the corresponding output current increased to compensate for the decreased input voltage range, this scaling down and reamplification changes the transconductance of the circuit, which can be undesirable in several applications.

In addition, there are applications in which a bidirectional output current is required. In a bidirectional output current, the voltage to current converter is capable of either supplying (sourcing) current or receiving (sinking) current.

Therefore, it can be appreciated that a voltage to current converter which has an extended dynamic range and which is also bidirectional is highly desirable.

SUMMARY OF THE INVENTION

It is, therefore, an object of this invention to provide a voltage to current converter which will accept an input voltage range which is near the power supply voltage levels used to power the circuit.

It is also an object of this invention to provide a voltage to current converter which is able to both source and sink current at its output.

Shown in an illustrated embodiment of the invention is a voltage to current converter circuit which has a differential amplifier in which the negative input of the differential amplifier is coupled to the voltage input terminal. The circuit also has first and second transistors, the sources of which are coupled to a first power supply voltage and the gates of which are coupled to the output of the differential amplifier, with the drain of the first transistor being coupled to the positive input of the differential amplifier, and the drain of the second transistor coupled to the output terminal. The circuit also includes a resistive element coupled between the drain of the first transistor and a reference voltage.

In a further aspect of the invention, the voltage to current converter includes a second differential amplifier in which the negative input of the second differential amplifier is coupled to the voltage input terminal. The circuit also includes third and fourth transistors, the sources of which are coupled to a second power supply voltage and the gates of which are coupled to an output of the second differential amplifier, with the drain of the third transistor being coupled to the positive input of the second differential amplifier, and the drain of the fourth transistor being coupled to the drain of the second transistor. The circuit also includes a second resistive element coupled between the drain of the third transistor and the reference voltage.

BRIEF DESCRIPTION OF THE DRAWINGS

The aforementioned and other features, characteristics, advantages, and the invention in general, will be better understood from the following, more detailed description taken in conjunction with the accompanying drawings in which.

Figure 4:
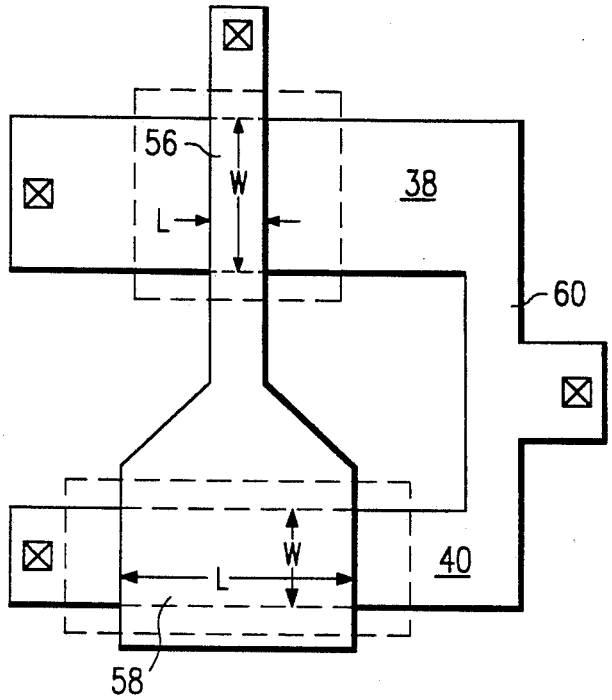
FIG. 4 is a plan view of two transistors shown in FIG. 2 as fabricated in an integrated circuit chip.

It will be appreciated that for purposes of clarity and where deemed appropriate, reference numerals have been repeated in the figures to indicate corresponding features and that FIG. 4 has not necessarily been drawn to scale in order to more clearly show important features of the present invention.

DESCRIPTION OF THE PREFERRED EMBODIMENT

The voltage to current converter circuit of the present invention achieves an extended dynamic range and a bidirectional current capability by utilizing two complementary operational amplifiers. Both of the negative inputs of the operation amplifiers are connected to the voltage input terminal. The first operational amplifier has an input common mode range near the positive supply voltage. The amplifier's output voltage is applied to the gate of a first p-channel transistor, the drain of which is connected both to the positive input of the first operational amplifier and to one end of a first resistor. The other end of the first resistor is connected to a reference voltage. Similarly, the second operational amplifier has an input common mode range near the negative power supply. The output of this amplifier is connected to the gate of a first n-channel transistor, the source of which is connected to the negative power supply voltage, which in the preferred embodiment is ground potential, and the drain of which is connected both to the positive input of the second operational amplifier and to one end of a second resistor, the other end of which is connected to the reference voltage.

When the input voltage is greater than the reference voltage, then this difference in voltage is developed across the first resistor and therefore the current through the first p-channel transistor is equal to this difference voltage divided by the resistance of the first resistor. During this time the output voltage of the second operational amplifier is below the threshold voltage of the first n-channel transistor and the first n-channel transistor is nonconductive, i.e., no current flows through the second resistor.

Similarly, when the input voltage is below the reference voltage, then the difference between the input voltage and the reference voltage is applied across the second resistor and the current through the first n-channel transistor is equal to the difference between the input voltage and the reference voltage divided by the resistance of the second resistor. During this time the output voltage of the first differential amplifier is near the positive supply voltage which causes the gate to source voltage of the first p-channel transistor to be less than the threshold voltage of this transistor, thereby causing the first p-channel transistor to be nonconductive.

A second p-channel transistor mirrors the current through the first p-channel transistor with the source of the second p-channel transistor tied to the positive supply voltage and the gate of the second p-channel transistor connected to the gate of the first p-channel transistor. The drain of the second p-channel transistor is connected to the current output terminal. Similarly a second n-channel transistor mirrors the current through the first n-channel transistor, the second n-channel transistor having its source connected to ground and its gate connected to the gate of the first n-channel transistor and its drain connected to the current output terminal. Therefore, when the input voltage is greater than the reference voltage, the current through the second p-channel transistor supplies current at the current output terminal, and when the input voltage is less than the reference voltage, then the current through the second p-channel transistor sinks current from the current output terminal.

Figure 1:
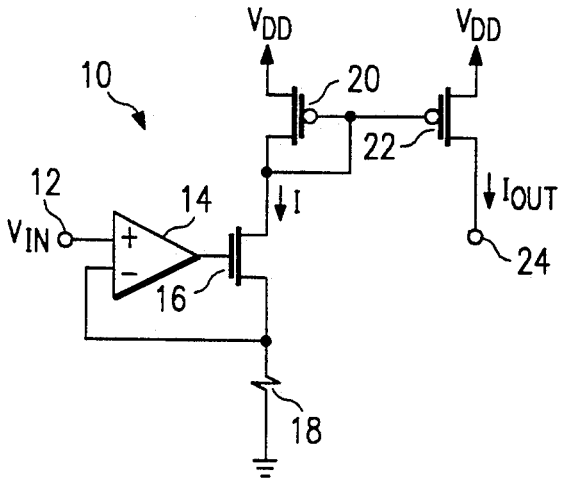
FIG. 1 (PRIOR ART)
FIG. 1 is a schematic diagram of a prior art voltage to current converter circuit.

Turning now to the drawings, a prior art voltage to current converter circuit 10 is shown in FIG. 1. A voltage input terminal 12 is connected to the positive input of an operational amplifier 14, the output of which is connected to the gate of an n-channel transistor 16. The source of the n-channel transistor 16 is connected to the negative input of the operational amplifier 14 and to one end of a resistor 18, the other end of which is connected to ground. The drain of the n-channel transistor 16 is connected to the drain and gate of a p-channel transistor 20 and also to the gate of another p-channel transistor 22. The sources of the p-channel transistors 20 and 22 are connected to a positive supply voltage, VDD. The drain of the p-channel transistor 22 is connected to a current output terminal 24.

The circuit of FIG. 1 develops a current across the resistor 18 which is equal to the input voltage divided by the value of the resistor 18. This current is mirrored through the current mirror transistors 20 and 22 to form an output current at the output terminal 24.

The prior art voltage to current converter circuit of FIG. 1 is limited in that it can only source current at the current output terminal 24 and in that the dynamic range is limited by the gate-to-source voltage of the transistors 20 and 22. For linear operation of the voltage to current converter circuit of FIG. 1 the output of the operational amplifier 14 cannot be greater than VDD minus the gate-to-source voltage ($V_{gs}$) of the p-channel transistors 20 and 22 necessary to support the current mirror action of transistors 20 and 22. Since transistor 16 operates as a source follower, the input voltage at the input terminal 12 therefore cannot be greater than VDD minus $V_{gs}$.

Figure 2:
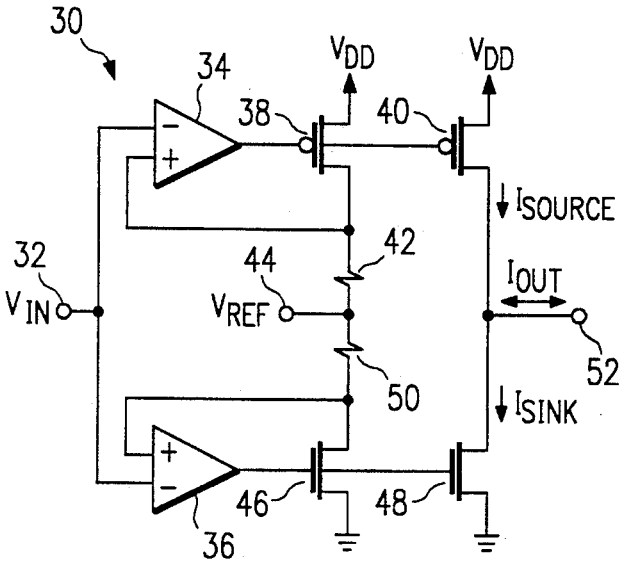
FIG. 2 is a schematic diagram of a voltage to current converter circuit according to the present invention.

The circuit of FIG. 2 shows a voltage to current converter circuit according to the present invention which overcomes the limited dynamic range of the circuit shown in FIG. 1. The voltage to current converter circuit 30 of FIG. 2 has a voltage input terminal 32 for receiving an input voltage $V_{IN}$. The voltage input terminal 32 is connected to the negative input of a first operational amplifier 34 and to the negative input of a second operational amplifier 36. The output of the operational amplifier 34 is connected to the gates of a first p-channel transistor 38 and a second p-channel transistor 40. The sources of the p-channel transistors 38 and 40 are connected to the positive supply voltage VDD. The drain of the p-channel transistor 38 is connected to the positive input of the operational amplifier 34 and also to one end of a first resistor 42, the other end of which is connected to a reference voltage input terminal 44. The output of the operational amplifier 36 is connected to the gates of a first n-channel transistor 46 and a second n-channel transistor 48. The sources of the n-channel transistor 46 and 48 are connected to ground. The drain of the n-channel transistor 46 is connected to the positive input of the operational amplifier 36 and also to one end of another resistor 50, the other end of which is connected to the reference voltage input terminal 44. The drains of the p-channel transistor 40 and the n-channel 48 are connected together and form a current output terminal 52.

Figure 3:
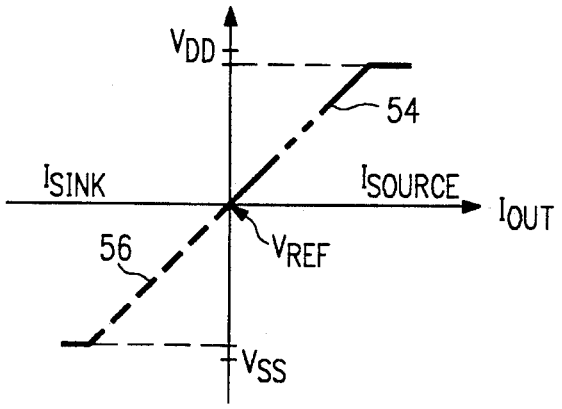
FIG. 3 is a plot of the transfer characteristics of the voltage to current converter circuit of FIG. 2.

In operation and with reference now to FIG. 3, when the input voltage $V_{IN}$ is greater than a reference voltage $V_{REF}$ at the reference voltage input terminal 44, then operational amplifier 34 will produce a current through the resistor 42 which is equal to the difference between $V_{IN}$ and $V_{REF}$ divided by the resistance of the resistor 42 and which passes through the p-channel transistor 38. The p-channel transistors 38 and 40 operate as a current mirror in that the current through the p-channel transistor 38 is mirrored by the p-channel transistor 40 to produce a current through the p-channel transistor 40 which is proportional to the current through the p-channel transistor 38. As will be described in detail below, the currents through the two p-channel transistors 38 and 40 (and also through the two n-channel transistors 46 and 48) will be the same if the width divided by the length (W/L) of the gate region of the p-channel transistor 38 is equal to W/L of the gate region of the p-channel transistor 40, and the currents of the two p-channel transistors will be proportional to each other in the same ratio as the W/L factors of the two p-channel transistors. This current through the p-channel transistor 40 is supplied to the current output terminal 52. During this time the output voltage of the operational amplifier 36 is near ground potential which causes the n-channel transistors 46 and 48 to be nonconductive.

Similarly, when the input voltage is less than the reference voltage, then the operational amplifier 36 will produce a current through the resistor 50 and the n-channel transistor 46 which is equal to $V_{IN}$ minus $V_{REF}$ divided by the resistance of the resistor 50. The n-channel transistors 46 and 48 operate as a current mirror, and the current through the n-channel transistor 48 is proportional to the current through the n-channel transistor 46. The current through the n-channel transistor 48 is supplied from the current output terminal 52. During this time the output voltage of the operational amplifier 34 is near VDD which causes the p-channel transistors 38 and 40 to be nonconductive.

The slope of the voltage versus current line, when the input voltage is greater than the reference voltage as shown by line 54 in FIG. 3, is determined by the resistance of the resistor 42 and the ratio of currents flowing through the p-channel transistor 38 and the p-channel transistor 40. Similarly, the slope of the voltage versus current line, when $V_{IN}$ is greater than $V_{REF}$ as shown by line 56 in FIG. 3, is determined by the resistance of the resistor 50 and the ratio of the currents flowing through the transistors 46 and 48. Therefore, the slope of line 54 can be different than the slope of line 56. The input voltage level at which the output current terminal 52 sources or sinks current is determined by the reference voltage $V_{REF}$.

The reference voltage $V_{REF}$ is generated by circuitry known to those skilled in the art and has not been shown in the drawings to avoid surplusage.

Advantageously, the voltage to current converter circuit 30 of FIG. 2 is able to receive input voltages which are near VDD and ground and still operate linearly. The upper voltage limit on $V_{IN}$ does not occur until $V_{IN}$ is near VDD at which point the p-channel transistor 38 enters it ohmic region. Similarly, the lower voltage limit on $V_{IN}$ is approximately ground potential at which point the n-channel transistor 46 enters its ohmic regions. Thus, the dynamic range of the voltage to current converter circuit 30 of FIG. 2 is near the power supply limits of the circuit. In comparison the gate to source voltage at which the p-channel transistor 38 and the n-channel transistor 46 enter their ohmic region is less than the gate to source voltage of the p-channel transistors 20 and 22 in FIG. 1 necessary to support the current mirror action.

FIG. 4 is a plan view of the p-channel transistors 38 and 40 showing a gate region 56 of the p-channel transistor 38 and a gate region 58 of the p-channel transistor 40. An active region 60 is used by both p-channel transistor 38 and p-channel transistor 40. FIG. 4 shows the length and width dimensions of the p-channel transistors 38 and 40, and as shown in FIG. 4, transistor 38 with gate region 56 has a much larger W/L ratio than does p-channel transistor 40 having gate region 58. Thus, the current through the p-channel transistor 38 will be greater than the current through the p-channel transistor 40 by an amount equal to the W/L ratio of the p-channel transistor 38 divided by the W/L ratio of the p-channel transistor 40. FIG. 4 is also applicable to the n-channel transistors 46 and 48 which are formed in a manner similar to the p-channel transistors 38 and 40.

Figure 5A:
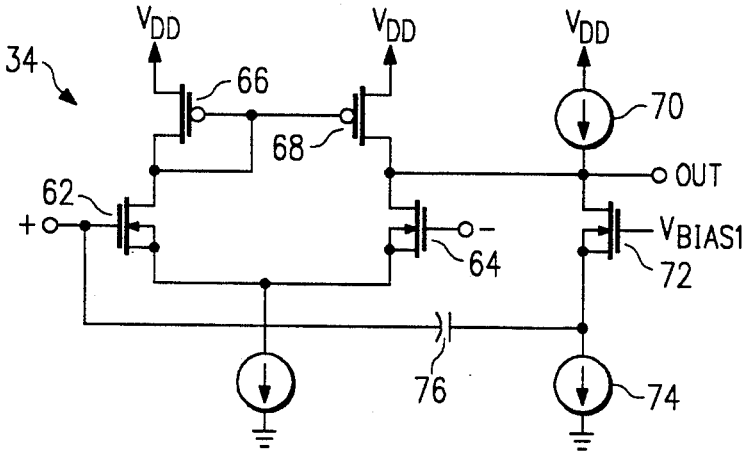
FIG. 5A and 5B are schematic diagrams of the differential amplifier circuits shown in FIG. 2.

The voltage to converter circuit 30 of FIG. 2 has a feedback path to the positive input of the operational amplifiers 34 and 36 which could create an unstable condition in the circuit. The operational amplifiers 34 and 36 are designed to compensate for this potential instability. FIG. 5A is a circuit diagram of the operational amplifier 34, and FIG. 5B is a circuit diagram of the operational amplifier 36.

As shown in FIG. 5A, the positive and negative inputs of the operational amplifier 34 are connected to the gates of two n-channel differential transistors 62 and 64. Connected to the drains of the differential transistors 62 and 64 are two p-channel transistors 66 and 68 which operate to provide the double-ended to single-ended output of the differential amplifier 34. Transistors 62, 64, 66, and 68 are configured in a common amplifier configuration well known to those skilled in the art. The output of the operational amplifier 34 is coupled to VDD through a current source 70 and to the drain of an n-channel transistor 72, the gate of which is connected to a bias voltage $V_{BIAS1}$, and the source of which is connected to another current source 74, the other end of which is connected to ground. Connected between the source of the n-channel transistor 72 and the positive input of the operational amplifier 34 is a compensation capacitor 76 which in the preferred embodiment is on the order of 2–3 picofarads. The bias voltage $V_{BIAS1}$ is generated by circuitry well known in the art and provides a gate voltage to make the n-channel transistor 72 conductive for all output voltages of the operational amplifier 34. This operational amplifier 34 shown in FIG. 5A provides a common mode input range which can extend near the positive supply voltage VDD and also provides the proper compensation to avoid a potential instability caused by the feedback to the positive input terminal of the operational amplifier 34.

Figure 5B:
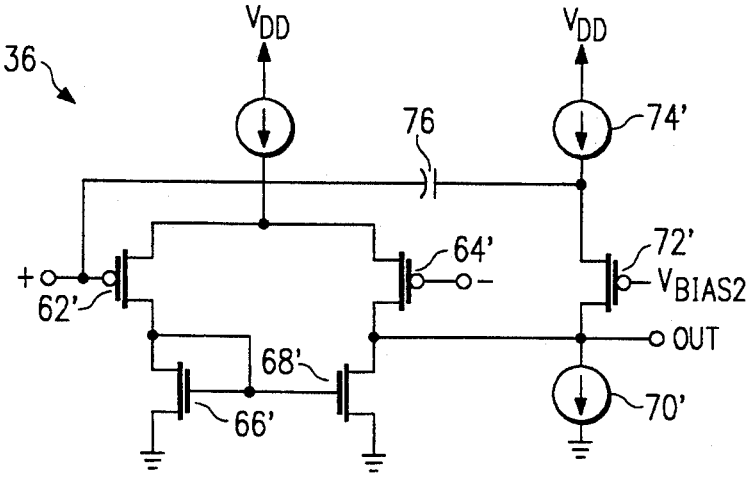

The schematic diagram shown in FIG. 5B for the operational amplifier 36 is complementary to the schematic diagram shown in FIG. 5A. The bias voltage $V_{BIAS2}$ for the transistor connected between the two current sources is generated by circuitry well known in the art and provides a gate voltage to make the p-channel transistor conductive for all output voltages of the operational amplifier 36. The operational amplifier 36 is able to provide a common mode input range which is near the negative or ground potential supply voltage.

Therefore, there has been described a voltage to current converter circuit which has an extended dynamic range as compared to prior art voltage to current converters and which provides a bidirectional output, that is, an output which can both supply current and sink current.

Although the invention has been described in part by making detailed reference to a certain specific embodiment, such detail is intended to be, and will be understood to be, instructional rather than restrictive. It will be appreciated by those skilled in the art that many variations may be made in the structure and mode of operation without departing from the spirit and scope of the invention, as disclosed in the teachings contained herein.

What is claimed is:

1. A bidirectional voltage to current converter, comprising:
   a) first and second voltage to current converters;
   b) an input terminal connected to both said first and second converters;
   c) an output terminal connected to both said first and second converters;
   d) said first converter supplying a current at said output terminal only when a voltage at said input terminal is greater than a reference voltage, and said second converter sinking a current at said output terminal only when said voltage at said input terminal is less than said reference voltage.

2. The converter of claim 1, wherein:
   a) said first voltage to current converter includes (i) a first differential amplifier driving the gate of a p-channel transistor coupled to said output terminal and (ii) an input of said first differential amplifier connected to said input terminal; and
   b) said second voltage to current converter includes (i) a second differential amplifier driving the gate of a n-channel transistor coupled to said output terminal and (ii) an input of said second differential amplifier connected to said input terminal.

3. The converter of claim 2, wherein:
   a) a second input of said first differential amplifier connects to a reference voltage through a first resistor with said first resistor connected to the drain of a second p-channel transistor with gate also driven by said first differential amplifier; and b) a second input of said second differential amplifier connects to a reference voltage through a second resistor with said second resistor connected to the drain of a second n-channel transistor with gate also driven by said second differential amplifier.

4. A voltage to current converter, comprising:

a) an input terminal;

b) an output terminal;

c) a reference terminal;

d) first and second voltage to current converters, each of said converters connected to all of said input terminal, said output terminal, and said reference terminal, with said second converter a complementary image of said first converter and outputting current only when said first converter is not outputting current.

* * * * *